US006910521B2

(12) United States Patent
Nanto et al.

(10) Patent No.: US 6,910,521 B2
(45) Date of Patent: Jun. 28, 2005

(54) CASTING APPARATUS AND MOLTEN METAL FEED APPARATUS

(75) Inventors: Hiroshi Nanto, Zama (JP); Akira Hirahara, Ayase (JP)

(73) Assignee: Toshiba Kikai Kabushiki Kaisha, Tokyo (JP)

( * ) Notice: Subject to any disclaimer, the term of this patent is extended or adjusted under 35 U.S.C. 154(b) by 0 days.

(21) Appl. No.: 10/422,836

(22) Filed: Apr. 25, 2003

(65) Prior Publication Data

US 2003/0201090 A1 Oct. 30, 2003

(30) Foreign Application Priority Data

Apr. 26, 2002 (JP) ..... 2002-127071

(51) Int. Cl.[7] ..... B22D 17/04

(52) U.S. Cl. ..... 164/312; 164/337; 164/513; 164/133; 164/113; 164/147.1; 164/148.1

(58) Field of Search ..... 164/312, 337, 164/513, 133, 113, 147.1, 148.1; 266/242

(56) References Cited

U.S. PATENT DOCUMENTS

| | | | | |
|---|---|---|---|---|
| 5,272,718 | A | | 12/1993 | Stenzel et al. |
| 6,399,017 | B1 | * | 6/2002 | Norville et al. ..... 266/242 |

FOREIGN PATENT DOCUMENTS

| | | | |
|---|---|---|---|
| DE | 1 041 652 | | 10/1958 |
| DE | 1041652 | * | 10/1958 |
| EP | 0 248 242 | | 12/1987 |
| EP | 0 366 790 | | 5/1990 |
| EP | 0 875 314 A1 | | 11/1998 |
| JP | 239354 | * | 9/2001 |
| JP | 2003-1397 | | 1/2003 |
| JP | 2003-1398 | | 1/2003 |
| JP | 2003-62661 | | 3/2003 |
| JP | 2003-62662 | | 3/2003 |
| JP | 2003-62663 | | 3/2003 |
| JP | 2003-71553 | | 3/2003 |
| JP | 2003-71558 | | 3/2003 |
| JP | 2003-88950 | | 3/2003 |
| JP | 2003-112247 | | 4/2003 |
| JP | 2003-112255 | | 4/2003 |
| JP | 2003-117650 | | 4/2003 |
| JP | 2003-136225 | | 5/2003 |

OTHER PUBLICATIONS

Patent Abstracts of Japan, vol. 2000, No. 26, Jul. 1, 2002.

* cited by examiner

*Primary Examiner*—Kiley S. Stoner
*Assistant Examiner*—I. H. Lin
(74) *Attorney, Agent, or Firm*—Pillsbury Winthrop LLP

(57) ABSTRACT

A molten metal feed apparatus which can feed molten metal into a casting apparatus by opening a vessel and which is free from leakage of the molten metal from the opening/closing part of the vessel, provided with a holding vessel having an opening at its bottom and holding a metal material, a lid for closing the opening, a drive means for making the lid move with respect to the holding vessel to open or close the opening, and an induction heating coil for heating the metal material by induction of a current to the metal material in the holding vessel and generating a magnetic field applying to the molten metal a force preventing leakage of the molten metal in the holding vessel from between the opening and the lid.

10 Claims, 18 Drawing Sheets

CASTING APPARATUS AND MOLTEN METAL FEED APPARATUS

BACKGROUND OF THE INVENTION

1. Field of the Invention

The present invention relates to a casting apparatus.

2. Description of the Related Art

In the field of die casting machines and other casting apparatuses, it is necessary to heat and melt metal from a solid state and feed the molten metal to the casting apparatus. As the method for heating and melting the metal, the technique of using induction heating to melt the metal and feeding that molten metal to the casting apparatus has been known. Induction heating is a method of heating metal for use for casting by inducing a current through the metal by electromagnetic induction and heating the metal by the Joule heat generated at that time.

On the other hand, a melted metal material is usually extremely high in temperature compared with the surroundings and is difficult to handle when feeding it to a casting apparatus. For example, with the method of scooping out melted metal material by a ladle to feed it to the casting machine, the metal material may solidify and oxidize.

As another method, for example, Japanese Unexamined Patent Publication (Kokai) No. 2001-239354 discloses a molten metal feed apparatus using induction heating to melt metal in a cylindrical furnace provided facing the cylinder of an injection apparatus and feeding that molten metal into a die casting machine.

The above molten metal feed apparatus is provided with an opening for ejecting the molten metal formed at the bottom of the cylindrical furnace into the cylinder and a lid for opening and closing the opening. By sliding the lid to open the opening, the molten metal in the cylindrical furnace flows into the cylinder by gravity.

This molten metal feed apparatus can feed the necessary amount of the molten metal into the injection apparatus without contact with air and can thereby maintain the quality of the molten metal.

With the molten metal feed apparatus disclosed in the above publication, however, there is a possibility of the molten metal in the furnace leaking out from the clearance formed between the opening and the lid closing that opening. If molten metal in the furnace leaks out, opening and closing of the lid will become difficult and the ladling quantity of the molten metal fed into the die casting machine may be dispersed.

SUMMARY OF THE INVENTION

An object of the present invention is to provide a molten metal feed apparatus which can heat and melt the necessary amount of a metal material in a furnace to obtain molten metal and feed that molten metal into a casting apparatus by opening the furnace and which is free from leakage of the molten metal from the opening/closing part of the furnace.

Another object of the present invention is to provide a casting apparatus provided with the above molten metal feed apparatus.

According to a first aspect of the present invention, there is provided a molten metal feed apparatus for feeding molten metal to a casting apparatus provided with a holding vessel having an opening at its bottom and holding a metal material, a lid for closing the opening, a drive means for making the lid move with respect to the holding vessel to open or close the opening, and an induction heating coil for heating the metal material by induction of a current to the metal material in the holding vessel and generating a magnetic field applying to the molten metal a force preventing leakage of the molten metal in the holding vessel from between the opening and the lid.

According to a second aspect of the present invention, there is provided a casting apparatus having a molten metal feeding means for feeding a molten metal, the molten metal feeding means having a holding vessel having an opening at its bottom and holding a metal material, a lid for closing the opening, a drive means for making the lid move with respect to the holding vessel to open or close the opening, and an induction heating coil for heating the metal material by induction of a current to the metal material in the holding vessel and generating a magnetic field applying to the molten metal a force preventing leakage of the molten metal in the holding vessel from between the opening and the lid.

In the present invention, when an induction current flows through the molten metal in the holding vessel, an electromagnetic force acts on the molten metal due to the electromagnetic induction action between the induction current and the magnetic field from the induction heating coil. The opening at the bottom of the holding vessel is closed by the lid, but with just closing the opening by the lid, a clearance is formed between the opening and the lid and the molten metal may leak out by its own weight. The magnetic field generated by the induction heating coil heats the molten metal by induction. Further, the electromagnetic force acting on the molten metal in the holding vessel applies a force to the molten metal preventing leakage from between the opening and lid.

BRIEF DESCRIPTION OF THE DRAWINGS

These and other objects and features of the present invention will become clearer from the following description of the preferred embodiments given with reference to the attached drawings, wherein.

DESCRIPTION OF THE PREFERRED EMBODIMENTS

Preferred embodiments of the present invention will be described in detail below while referring to the attached figures.

First Embodiment

Figure 1:
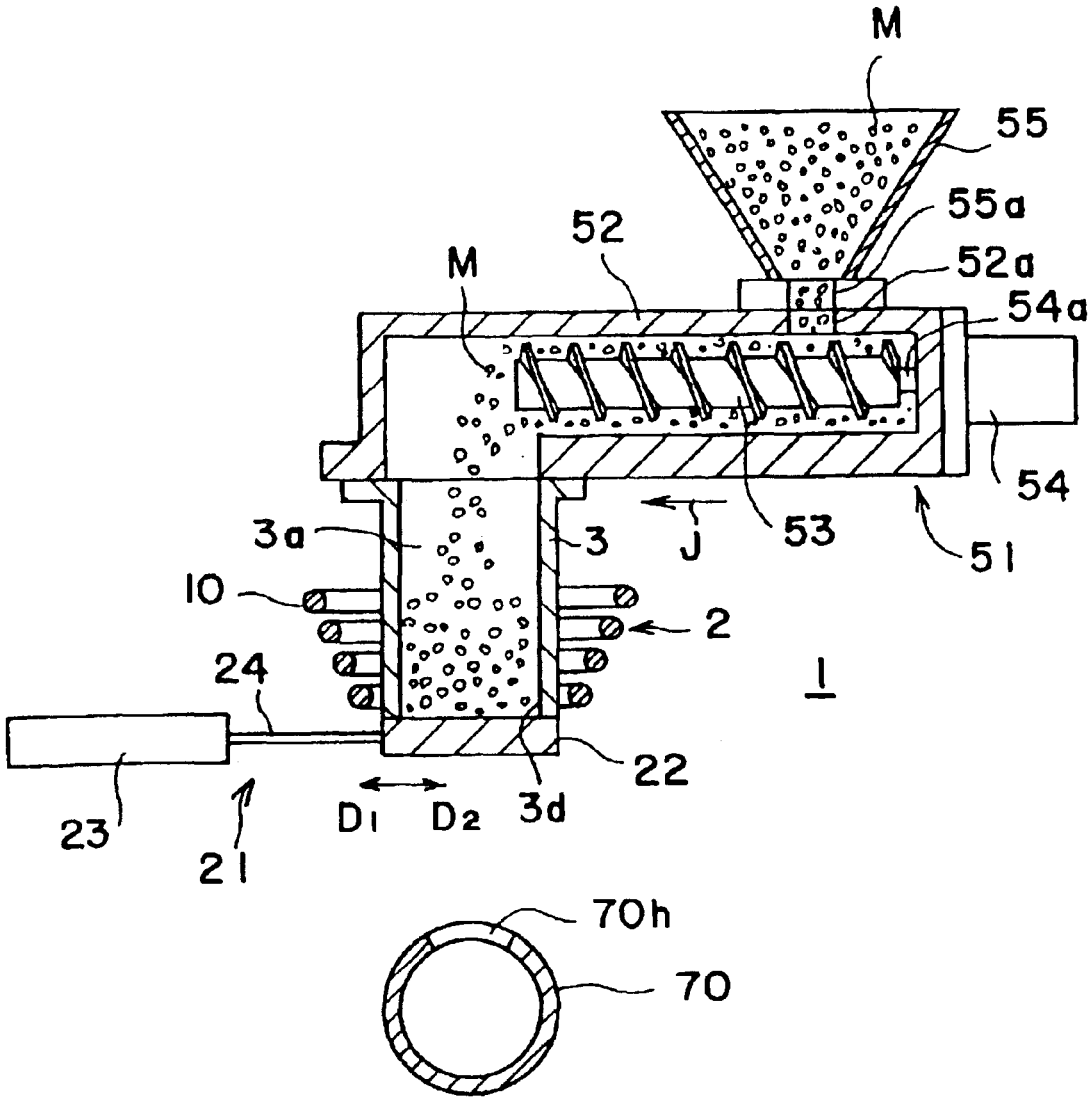
FIG. 1 is a sectional view of a molten metal feed apparatus according to an embodiment of the present invention.

FIG. 1 is a sectional view of a molten metal feed apparatus according to an embodiment of the present invention.

The molten metal feed apparatus 1 shown in FIG. 1 has a melting heater 2 and a material feed mechanism 51.

The material feed mechanism 51 has a hopper 55, a cylinder 52, and a screw 53.

The hopper 55 has a conical shape and can hold a metal material M inside it. The hopper 55 has a feeder 55*a* communicating with the inside of the cylinder 52 at its bottom end.

The metal material M fed into the hopper 55 is fed into the cylinder 52 through the feeder 55*a* by its own weight.

The metal material M stored in the hopper 55 is for example comprised of aluminum alloy or another metal in a spherical or elongated granular shape.

The cylinder 52 is comprised of a tubular member and is formed at part of its outside with a port 52*a* communicating with the feeder 55*a* of the hopper 55.

The front end side of the cylinder 52 is connected to the top end of the later explained holding vessel 3. The inside of the cylinder 52 and the inside of the holding vessel 3 are communicated with each other by this.

The screw 53 is provided rotatably inside the cylinder 52. One end of the screw 53 is connected with an output shaft 54*a* of a motor 54 affixed to one end of the cylinder 52.

When the screw 53 is made to turn in a predetermined direction by the rotation of the motor 54, the metal material M fed from the hopper 55 to the inside of the cylinder 52 is transported in the direction of the arrow J shown in FIG. 1 and drops from the front end of the cylinder 52 to the inside of the holding vessel 3. The amount of the metal material M transported to the holding vessel 3 (amount fed) is determined in accordance with the amount of rotation of the screw 53.

The melting heater 2 has the holding vessel 3 arranged above a gate 70*h* of the sleeve 70 of the later explained die casting machine, an induction heating coil 10 arranged around the holding vessel 3, and an opening/closing mechanism 21.

The opening/closing mechanism 21 has a lid 22 and a cylinder apparatus 23.

The lid 22 is a plate-shaped member able to close the opening 3*d* of the bottom (bottom end) of the holding vessel 3 by being moved to face the opening 3*d*.

This cylinder apparatus 23 is provided with a piston rod 24 linked at its front end to the lid 22. This piston rod 24 extends or contracts in the directions of the arrows D1 and D2 by for example compressed air or hydraulic power. By the piston rod 24 sliding in the directions D1 and D2, the opening 3*d* of the bottom end of the holding vessel 3 is opened/closed by the lid 22.

Figure 2:
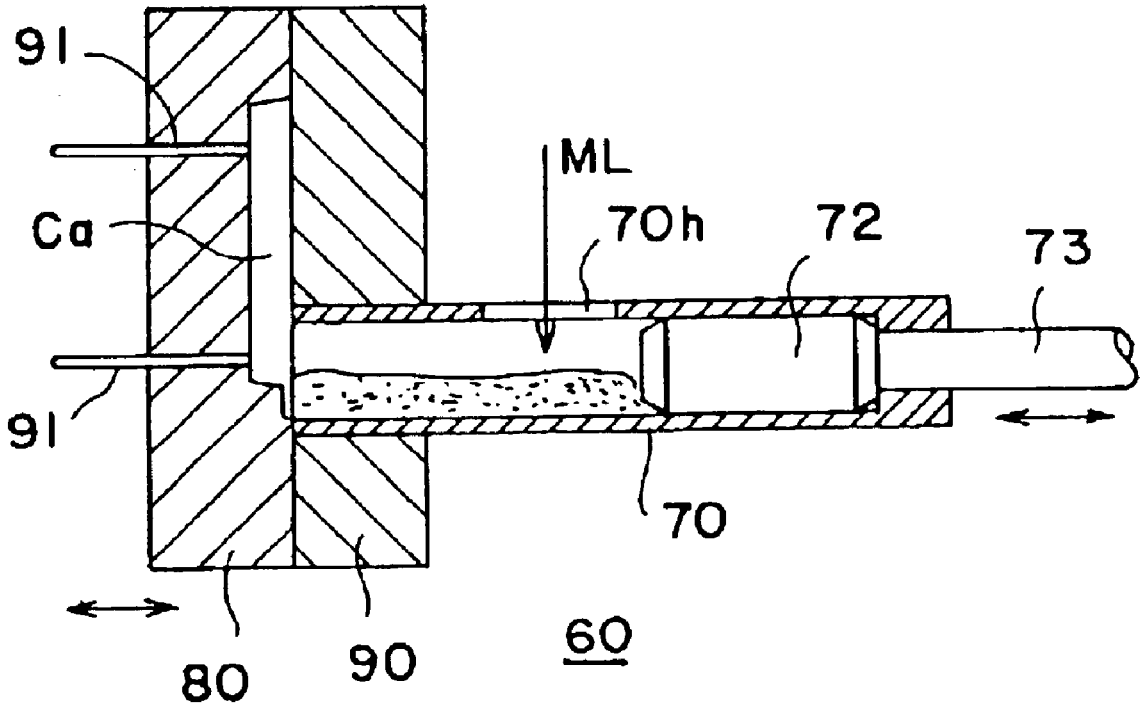
FIG. 2 is a sectional view of the configuration of key parts of a die casting machine as an example of a casting apparatus according to the present invention.

FIG. 2 is a sectional view of the configuration of key parts of a die casting machine as an example of a casting apparatus.

As shown in FIG. 2, the die casting machine 60 has a fixed die 90, a movable die 80 provided to be able to be opened and closed with respect to the fixed die, a sleeve 70 comprised of a tubular member provided at the fixed mold 90, and a plunger tip 72 fixed to the front end of a plunger rod 73 and fitting into the inner circumference of the sleeve 70.

The sleeve 70 is communicated with a cavity Ca formed between the clamped fixed die 90 and movable die 80.

In the state with the fixed die 90 and movable die 80 clamped by a not shown clamping mechanism, a predetermined amount of molten metal (metal material) ML is fed into the sleeve 70 through the gate 70*h* of the sleeve 70.

Next, the molten metal ML in the sleeve 70 is injected into the cavity Ca formed between the fixed die 90 and the movable die 80 by the action of the plunger tip 72.

After the molten metal ML filled in the cavity Ca solidifies, the movable die 80 is opened and the casting in the cavity Ca is ejected by ejection pins 91 provided at the movable die 80.

Figure 3A:
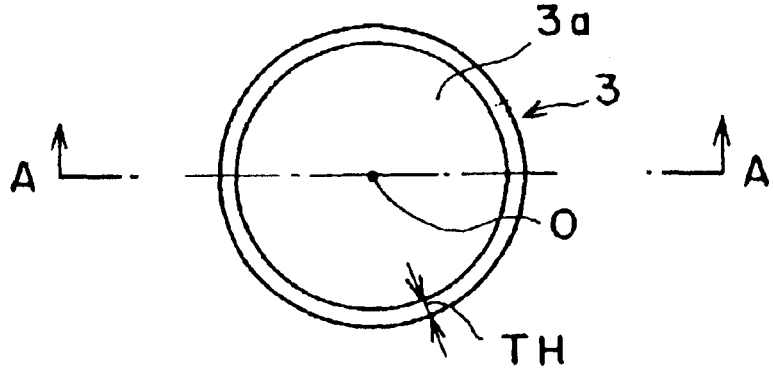
FIG. 3A and FIG. 3B are views of the structures of a holding vessel and induction heating coil.
Figure 3B:
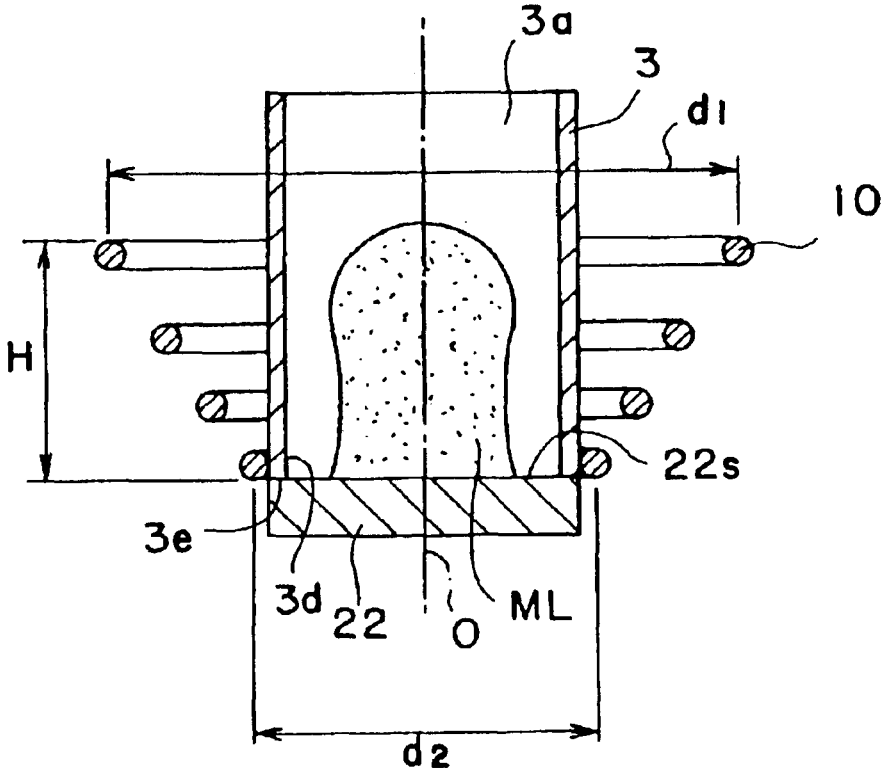

FIG. 3A and FIG. 3B are views of the structures of the holding vessel 3 and induction heating coil 10, wherein FIG. 3A is a top view of the holding vessel 3 and FIG. 3B is a sectional view along the line A—A shown in FIG. 3A.

As shown in FIG. 3A and FIG. 3B, the holding vessel 3 is comprised of a tubular member having a holding space 3*a* able to hold the metal material M. The holding vessel 3 is formed by a material such as austenitic stainless steel, copper, copper alloy, or another nonferromagnetic metal, or electrically insulating ceramic or another insulator material. Note that these materials are made nonferromagnetic. The reason for using such nonferromagnetic materials is to prevent magnetic flux from concentrating at the holding vessel 3 at the time of induction heating or to cause a larger electromagnetic force to act on the metal material M held in the holding vessel 3 by the induction heating coil 10.

The opening 3*d* at the bottom end of the holding vessel 3, as shown in FIG. 3B, is closed by the lid 22. At this time, the abutting face 22*s* of the lid 22 facing the bottom end face 3*e* of the holding vessel 3 is arranged to contact the bottom end face 3*e*, but a clearance may form between the bottom end face 3*e* and abutting face 22*s*.

The induction heating coil 10 is arranged around the holding vessel 3 concentrically with the center axis O of the holding vessel 3.

The bottom end side of the induction heating coil 10 along the center axis O is positioned near the contact position of the bottom end face 3*e* of the holding vessel 3 and the abutting face 22*s* of the lid 22.

Further, the diameter d1 of the top end side of the induction heating coil 10 along the center axis O is the maximum diameter, while the diameter d2 of the bottom end side is the minimum one. The diameter of the induction heating coil 10 gradually becomes smaller from the top end to the bottom end.

The induction heating coil 10 is for example supplied with tens of kHz or so of high frequency current. When the induction heating coil 10 is supplied with high frequency current, a magnetic field is generated. This magnetic field induces a current in the metal material M in the holding vessel 3. If current flows through the metal material M, Joule heat results in the metal material heating up and melting. Due to this, the metal material M becomes the molten metal ML.

After the metal material M becomes the molten metal ML, the electromagnetic induction action between the induction current flowing through the molten metal ML and the magnetic field generated at the induction heating coil 10 cause an electromagnetic force to act on the molten metal ML. This electromagnetic force is mainly a force directed toward the center of the holding vessel 3.

Here, the force acting on the molten metal ML melted by the induction heating coil 10 of the above shape will be explained referring to FIG. 4.

Figure 4:
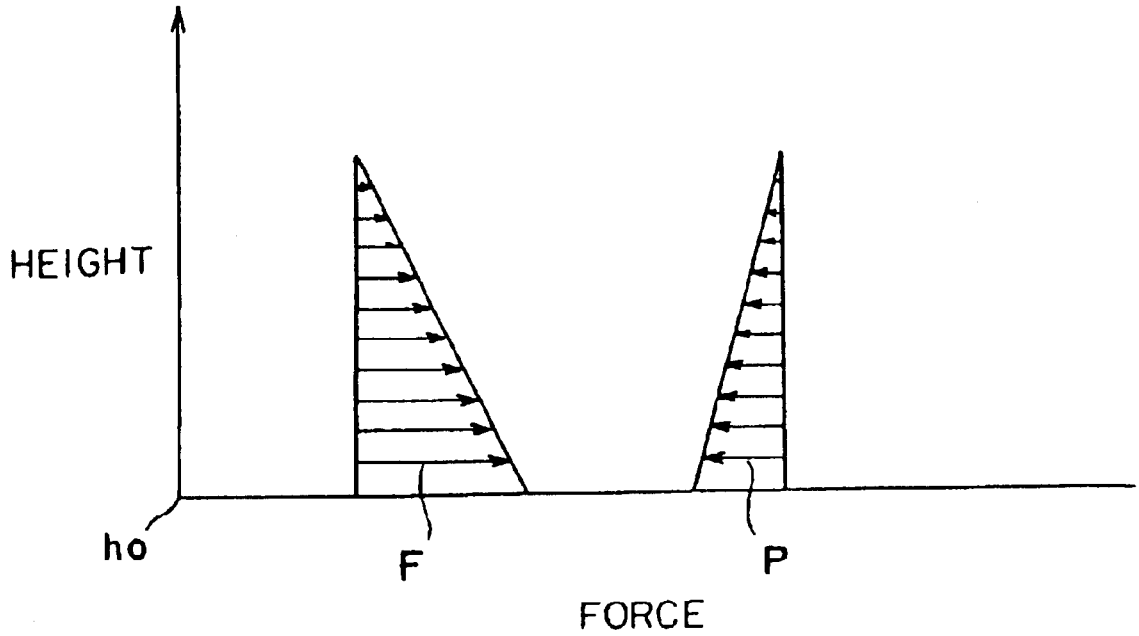
FIG. 4 is a graph of the electromagnetic force acting on the molten metal by the electromagnetic induction action between the induction current flowing through the molten metal ML and the magnetic field generated by the induction heating coil and the liquid pressure of the molten metal.

FIG. 4 is a graph of the electromagnetic force F acting on the molten metal ML by the electromagnetic induction action between the induction current flowing through the molten metal ML and the magnetic field generated by the induction heating coil 10 and the liquid pressure P of the molten metal ML.

If the contact position of the bottom end face 3*e* of the holding vessel 3 and the abutting face 22*s* of the lid 22 is made the reference height $h_0$, the liquid pressure acting on the now liquid molten metal ML of the holding vessel 3 becomes the maximum at the reference height ho and becomes smaller toward the top side of the holding vessel 3.

On the other hand, since the induction heating coil 10 has the above shape, the magnetic flux of the magnetic field generated at the inner circumference of the induction heating coil 10 becomes maximum at the bottom end side of the induction heating coil 10 and falls toward the top end side.

Therefore, the electromagnetic force F acting on the molten metal ML in the center axis direction of the holding vessel 3 due to the induction heating coil 10 becomes maximum near the reference height $h_0$ due to the shape of the induction heating coil 10 and becomes smaller toward the top side of the holding vessel 3.

Accordingly, the molten metal M of the holding vessel 3 becomes the shape such as shown in FIG. 3B.

The shape of the molten metal ML shown in FIG. 3B becomes close to a cylindrical shape with a diameter substantially equal from the bottom end to the top end. At the bottom end side of the holding vessel 3, the inner circumferential surface of the holding vessel 3 and the molten metal ML are separated from each other.

That is, the molten metal ML in the holding vessel 3 is acted upon by a force keeping the height relatively low and preventing leakage from between the bottom end face 3*e* of the holding vessel 3 and the abutting face 22*s* of the lid 22.

Therefore, it is possible to prevent the molten metal ML from leaking out by its own weight from the holding vessel 3 in the state with the lid 22 closing the opening 3*d*.

Figure 5:
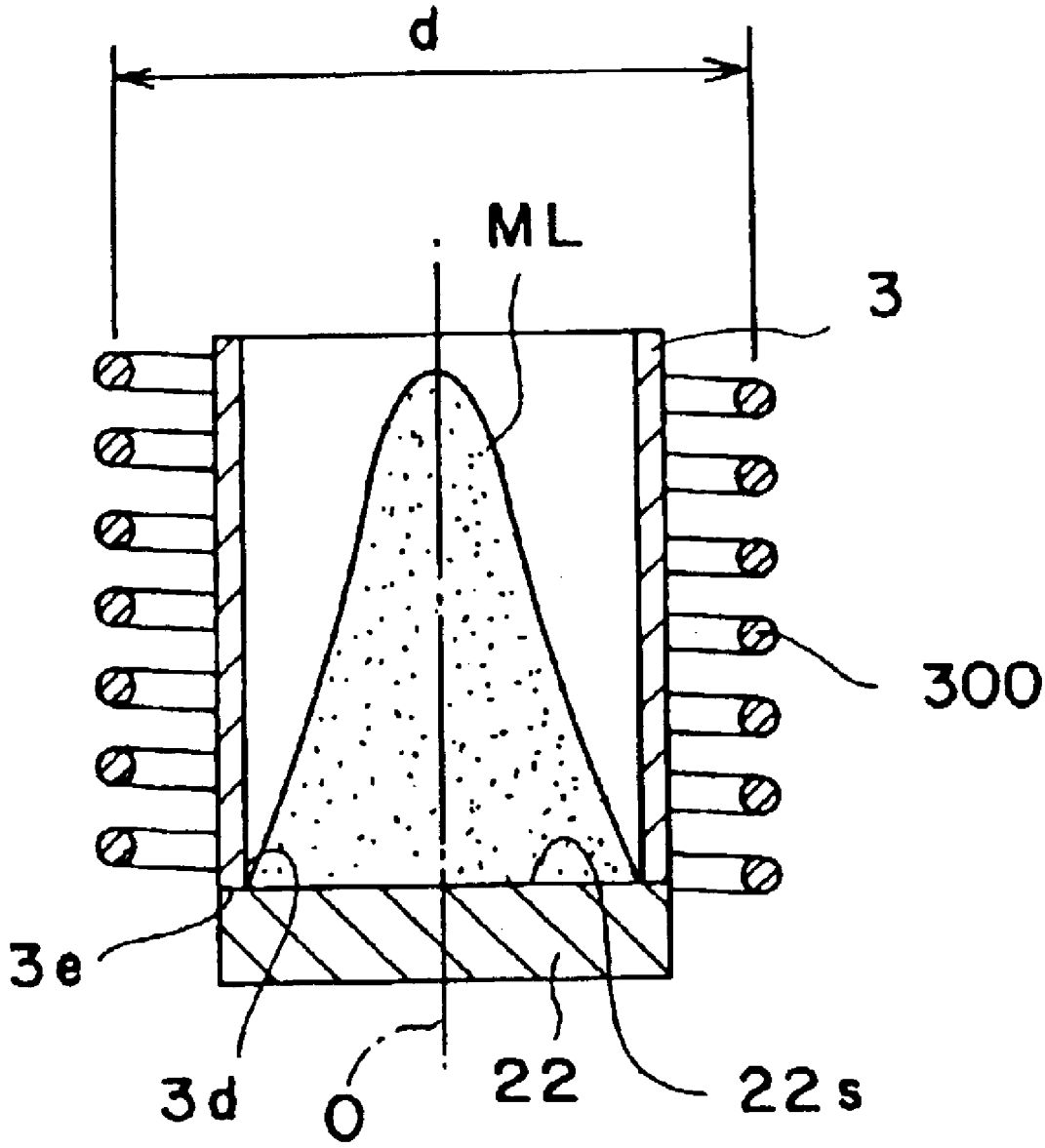
FIG. 5 is a sectional view of an example of the state of molten metal in the holding vessel in the case of arranging an induction heating coil with a fixed diameter at the entire region at the outside of the holding vessel along the center axis without considering the shape of the induction heating coil.

Here, FIG. 5 is a sectional view of an example of the state of molten metal ML in the holding vessel 3 in the case of arranging an induction heating coil 300 with a fixed diameter d at the entire region at the outside of the holding vessel 3 along the center axis O without considering the shape of the induction heating coil.

Figure 6:
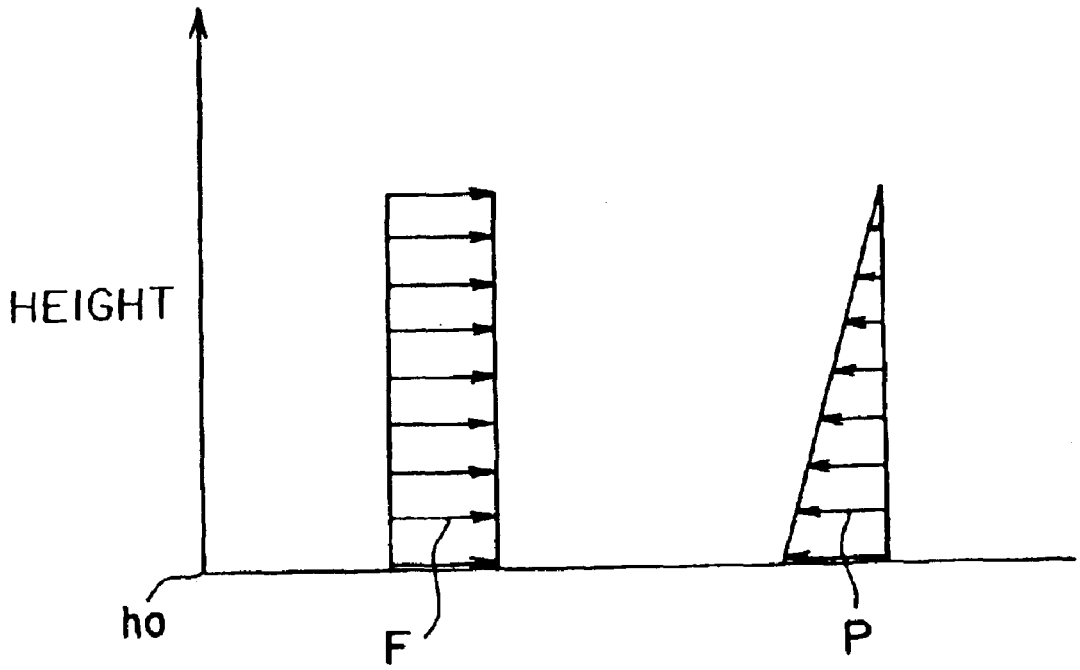
FIG. 6 is a graph of the electromagnetic force acting on the molten metal and the liquid pressure of the molten metal in the case of the induction heating coil shown in FIG. 5.

As shown in FIG. 5, if the diameter d of the induction heating coil 300 is substantially constant, the electromagnetic force F acting on the molten metal ML in the center axis direction of the holding vessel 3 becomes a substantially constant value along the center axis direction as shown for example in FIG. 6.

On the other hand, the liquid pressure P acting on the then liquid molten metal ML of the holding vessel 3 becomes maximum at the reference height $h_0$ and becomes smaller toward the top side of the holding vessel 3.

Therefore, from the relationship between the electromagnetic force F and the liquid pressure P, the molten metal ML ends up shaped as shown in FIG. 5 with a high height and flaring sides and the molten metal ML may leak out from between the bottom end face 3*e* of the holding vessel 3 and the abutting face 22*s* of the lid 22. It is therefore necessary to generate a stronger electromagnetic force to prevent this.

As explained above, by forming the induction heating coil 10 into a suitable shape, it is possible to prevent the molten metal ML from leaking by its own weight from the holding vessel 3 in the state with the lid 22 closing the opening 3*d* by a relatively small electromagnetic force. Further, by suitably selecting not only the shape of the induction heating coil 10, but also the shape of the induction heating coil 10 and the arrangement of the induction heating coil 10 with respect to the holding vessel 3 or just the arrangement of the induction heating coil 10 with respect to the holding vessel 3, it is possible to prevent the molten metal ML from leaking by its own weight from the holding vessel 3 in the state with the lid 22 closing the opening 3*d*.

Note that to determine the shape or arrangement of the induction heating coil 10, it is necessary to consider the relationships among the intensity of the magnetic field generated by the induction heating coil 10, the amount of the metal material M fed into the holding vessel 3, the height H of the induction heating coil 10 along the center axis O, etc.

Here, another example of an induction heating coil capable of preventing leakage of the molten metal ML from between the bottom end face 3*e* of the holding vessel 3 and the abutting face 22*s* of the lid 22 will be explained with reference to FIG. 7A and FIG. 7B.

Figure 7A:
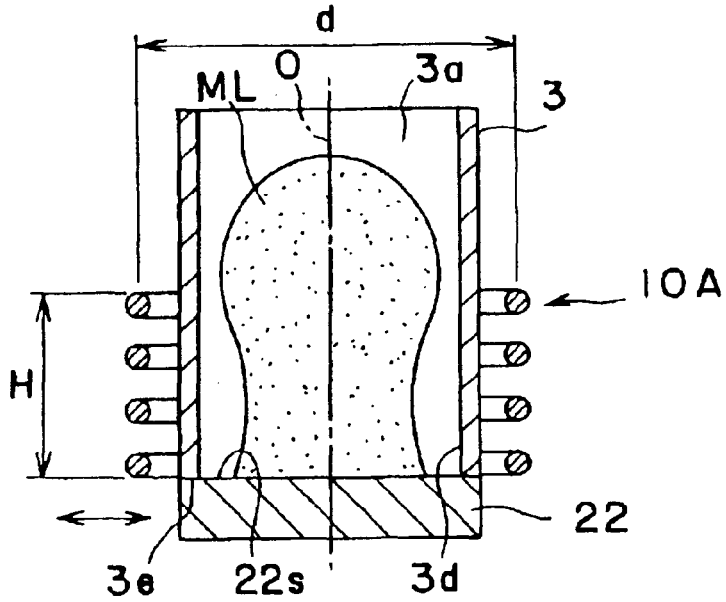
FIG. 7A and FIG. 7B are sectional views of another example of an induction heating coil according to an embodiment of the present invention.

The induction heating coil 10A shown in FIG. 7A is arranged at the outer circumference of the holding vessel 3 in the same way as the above induction heating coil 10. Further, the induction heating coil 10A is formed substantially equal in diameter d from the top end to the bottom end. The bottom end of the induction heating coil 10A is arranged near the position where the bottom end face 3*e* of the holding vessel 3 and the abutting face 22*s* of the lid abut.

The height H of the induction heating coil 10A in the direction along its center axis O is limited to a predetermined value so that the electromagnetic force acts only below the molten metal ML in the holding vessel 3. That is, the induction heating coil 10A is arranged so that the electromagnetic force directed toward the center axis O concentrates and acts only at the bottom region of the molten metal ML in the holding vessel 3 relative to the amount of molten metal ML in the holding vessel 3. Due to this, the height of the molten metal ML is suppressed and the liquid pressure of the bottom region becomes lower and balanced with the relatively low electromagnetic force.

By restricting the height H of the induction heating coil 10A relative to the amount of the molten metal ML in the holding vessel 3, as shown in FIG. 7A, when the inner circumferential surface of the holding vessel 3 and the molten metal ML separate at the bottom end side of the holding vessel 3, it becomes possible to prevent leakage of the molten metal ML from between the bottom end face 3*e* of the holding vessel 3 and the abutting face 22*s* of the lid 22.

Figure 7B:
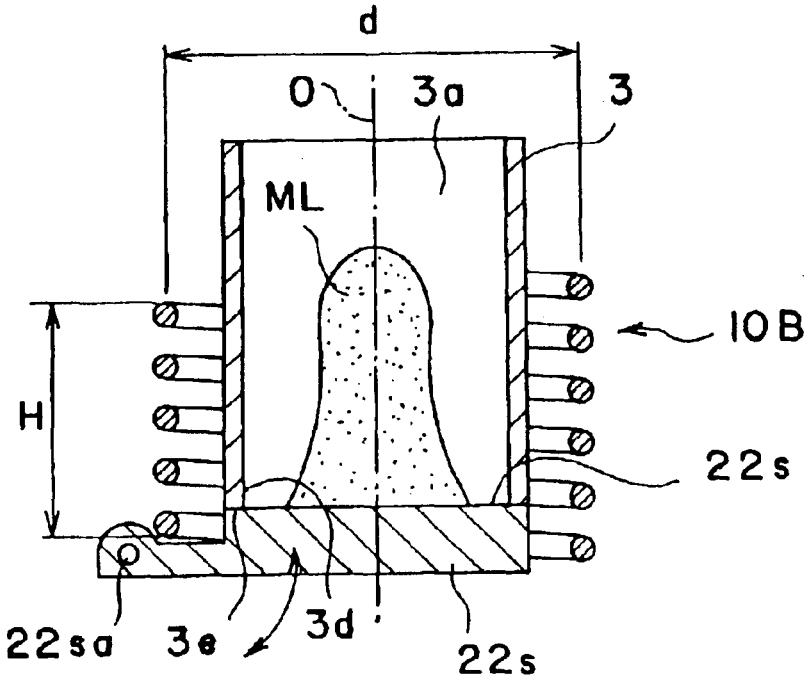

The induction heating coil 10B shown in FIG. 7B has a shape and arrangement similar to the induction heating coil 10A shown in FIG. 7A, but the bottom end of the induction heating coil 10B is arranged further lower from the bottom end face 3*e* of the holding vessel 3.

By arranging the bottom end of the induction heating coil 10B further lower than the bottom end face 3*e* of the holding vessel 3 in this way, it is possible to increase the electromagnetic force directed to the center axis O at the position of the bottom end of the holding vessel 3 compared with the induction heating coil 10A. As a result, compared with the induction heating coil 10A, it becomes possible to prevent more reliably the leakage of the molten metal ML from between the bottom end face 3*e* of the holding vessel 3 and the abutting face 22*s* of the lid 22.

Figure 8A:
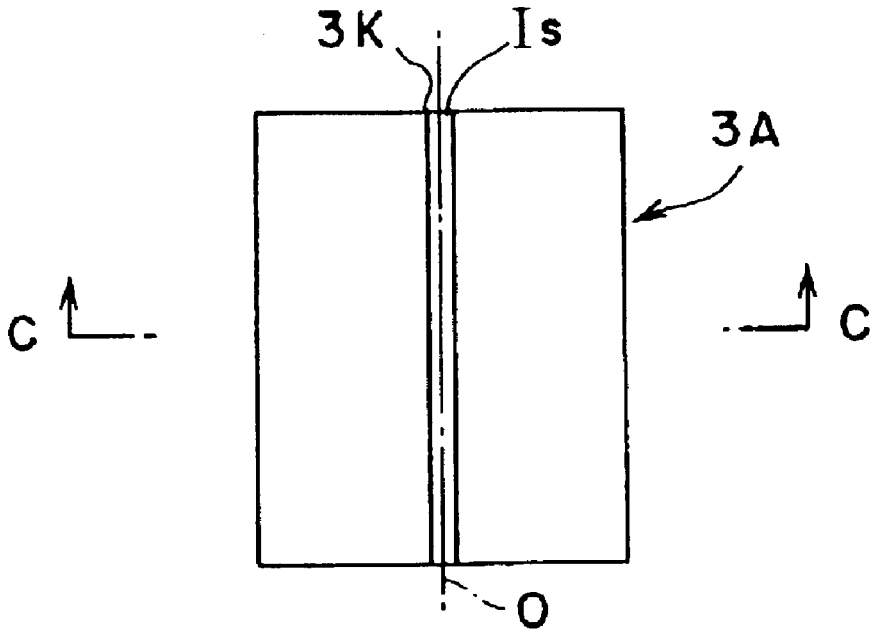
FIG. 8A and FIG. 8B are views of another type of the holding vessel according to an embodiment of the present invention.
Figure 8B:
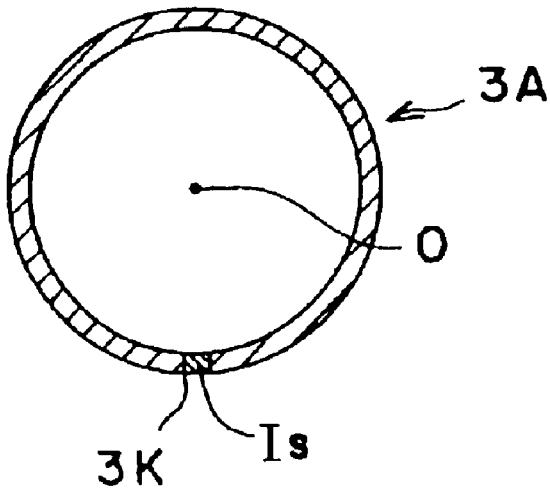

FIG. 8A and FIG. 8B are views of another type of the holding vessel 3, where FIG. 8A is a front view and FIG. 8B is a sectional view along the line C—C in FIG. 8A.

When the holding vessel 3 is formed by a ferromagnetic material such as iron, an eddy current is generated in the circumferential direction of the holding vessel 3 by the magnetic field generated by the induction heating coil 10 and the possibility arises of the holding vessel 3 being heated.

Therefore, the holding vessel 3A shown in FIG. 8A and FIG. 8B is formed with a notch 3*k* at part of its surface along the center axis O. By forming this notch 3*k*, the path of current in the circumferential direction of the holding vessel 3A caused at the time of induction heating is cut and the holding vessel 3A can be prevented from heating up.

Further, the notch 3*k* is for example filled with a ceramic or other insulating member Is. By this, it is possible to prevent the atmosphere from invading the holding vessel 3A and possible to keep the inside of the holding vessel 3A a nonoxidizing atmosphere. Note that when there is no problem even if the atmosphere invades the inside of the holding vessel 3A, the insulating member Is need not be provided.

As another method for preventing heating of the holding vessel 3, it may be considered to adjust the thickness TH of the holding vessel 3 shown in FIG. 3A.

The depth of penetration $\delta$ of the eddy current generated at the holding vessel 3 can be found from a predetermined formula from the resistance $\rho$ ($\Omega\cdot$m) of the holding vessel 3, the magnetic permeability $\mu$ of the holding vessel 3, and the frequency f (Hz) of the current applied to the induction heating coil 10.

By making the thickness TH of the holding vessel 3 smaller than the depth of penetration $\delta$ of the eddy current, it is possible to prevent heating of the holding vessel 3.

Figure 9:
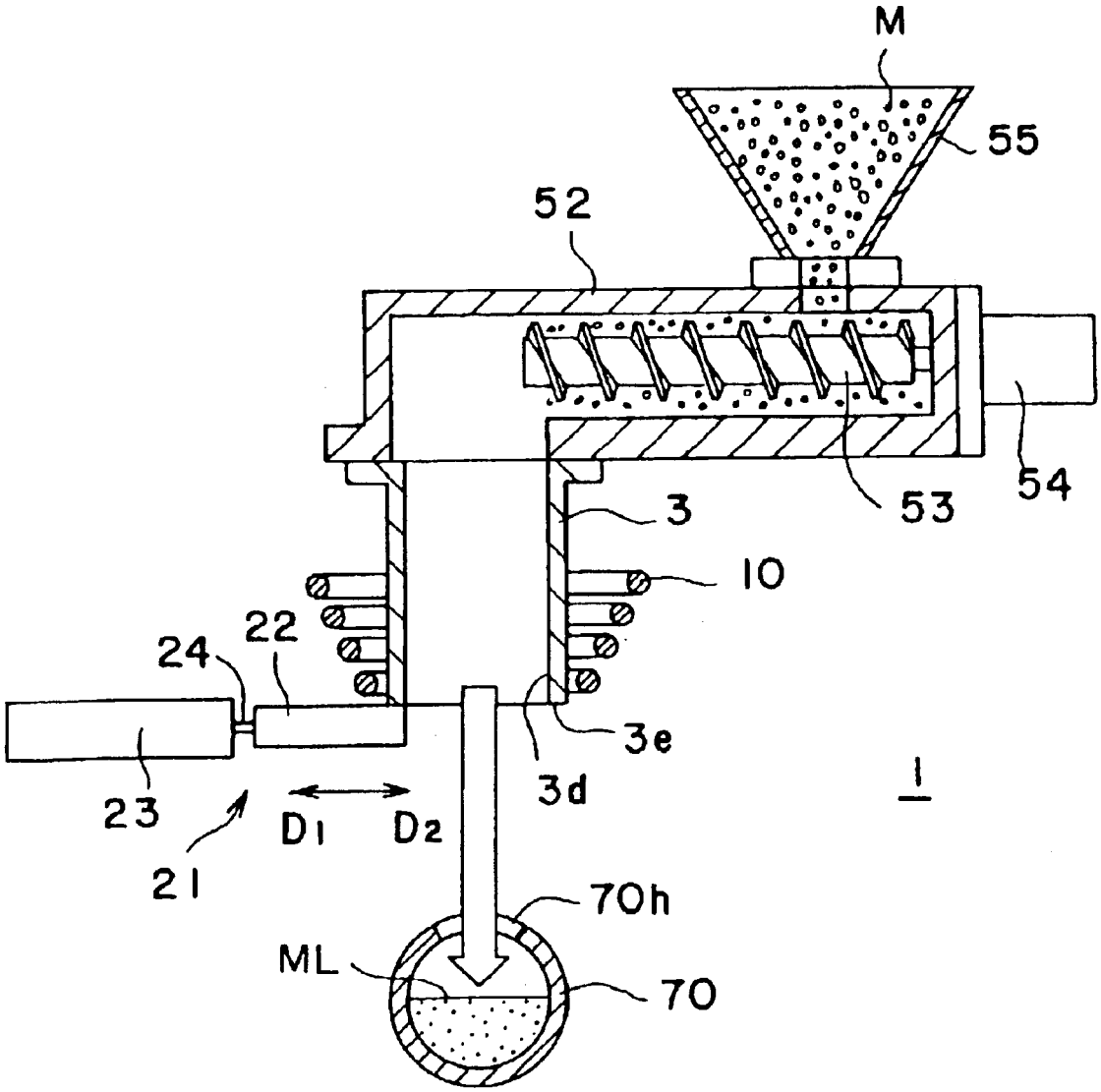
FIG. 9 is a sectional view of the state of allowing molten metal to fall by its own weight from the opening IS of the holding vessel and be fed into the sleeve.

In the molten metal feed apparatus 1 of the above configuration, if heating and melting the metal material M in the holding vessel 3 and sliding the lid 22 in the direction D1 as shown in FIG. 9 after reaching a predetermined temperature, the molten metal ML will drop out from the opening 3*d* of the holding vessel 3*d* by its own weight and be fed to the sleeve 70 of the die casting machine through the gate 70*h*.

As explained above, according to the present embodiment, when heating and melting the metal material M in the holding vessel 3 by induction heating to obtain the molten metal ML, by determining the shape and/or arrangement of the induction heating coil 10 to heat the metal material M by induction heating and enable generation of a magnetic field causing a force for preventing leakage of the molten metal ML from between the bottom end face 3*e* of the holding vessel 3 and the abutting face 22*s* of the lid 22 to act on the molten metal, it is possible to prevent leakage of the molten metal ML without any alteration in the opening/closing mechanism 21 of the holding vessel 3.

Note that in the above embodiment, the explanation was given while mentioning several types of the induction heating coil 10, but the present invention is not limited to these coils. It is also possible to combine the above types and possible to employ other types.

Second Embodiment

Figure 10:
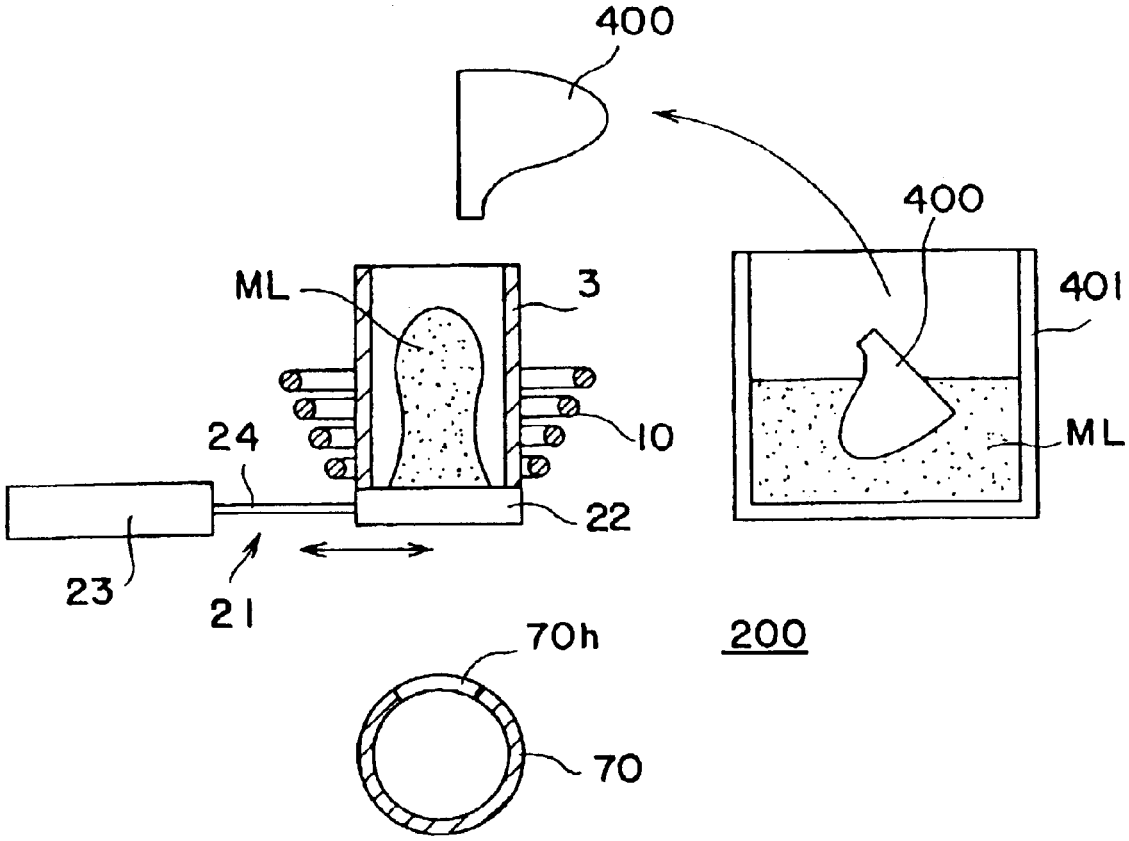
FIG. 10 is a view of the configuration of a molten metal feed apparatus according to a second embodiment of the present invention.

FIG. 10 is a view of the configuration of a molten metal feed apparatus according to a second embodiment of the present invention. Note that in FIG. 10, components the same as in the molten metal feed apparatus 1 of the first embodiment are assigned the same reference numerals.

In the first embodiment, the explanation was given with reference to an example of the material feed mechanism 51 for feeding a metal material in the solid state as the metal material feeding means of the present invention, but in the molten metal feed apparatus 200 according to this embodiment, the holding vessel 3 is fed not a metal material in a solid state, but a metal material in a liquid state, that is, the molten metal ML. The rest of the configuration is exactly the same as in the first embodiment explained above.

In FIG. 10, the melting furnace 401 holds molten metal ML obtained by melting for example aluminum.

Normally, with the melting furnace 401, the aluminum can only be raised in temperature to about 750° C. Sometimes, however, it is desired to feed aluminum into a die casting machine at the state of an extremely high temperature of about 800° C.

In this case, a predetermined amount of the molten metal ML of aluminum in the melting furnace 401 is scooped up by a ladle 400 held by a not shown conveyance mechanism and conveyed to the holding vessel 3.

In the holding vessel 3, in the same way as in the above embodiment, the melt of the molten metal ML of aluminum is heated by induction heating to raise it in temperature.

By configuring the present embodiment in this way, it becomes possible to raise the temperature of the molten metal ML to one not possible in a melting furnace 401 and feed it to a die casting machine or other casting apparatus.

Note that the molten metal feed apparatus 200 according to the present embodiment can make use of the various modifications of the holding vessel 3 and induction heating coil 10 explained above.

Third Embodiment

Figure 11:
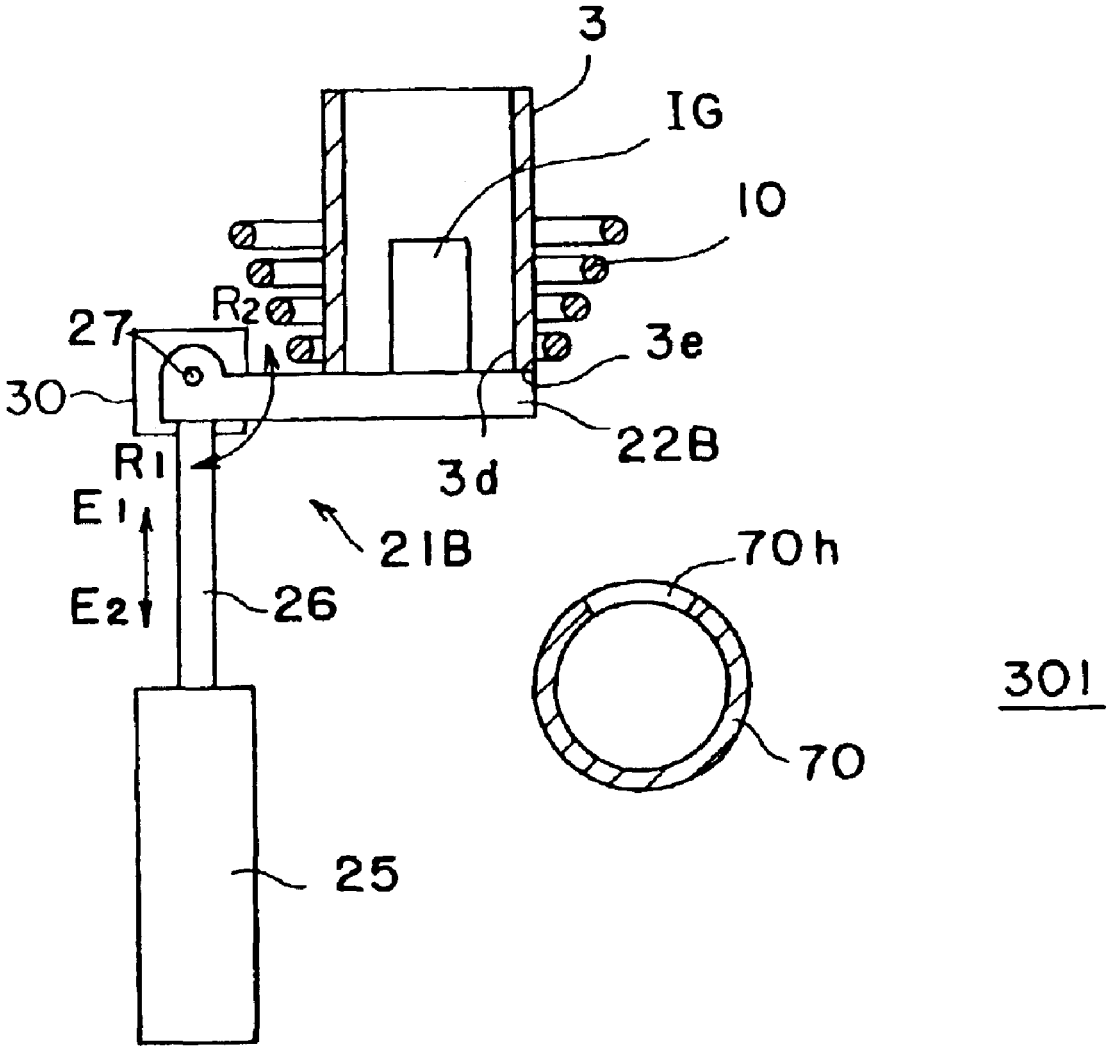
FIG. 11 is a view of the configuration of a molten metal feed apparatus according to a third embodiment of the present invention.

FIG. 11 is a view of the configuration of a molten metal feed apparatus according to a third embodiment of the present invention. Note that in FIG. 11, components the same as the molten metal feed apparatus 1 according to the first embodiment are assigned the same reference numerals.

In the first and second embodiments, the case of feeding a granular state metal material or molten metal into the holding vessel 3 was explained, but in the present embodiment, the case of feeding metal in a solid state such as an ingot or billet into the holding vessel 3 will be explained.

The molten metal feed apparatus 301 shown in FIG. 11 has an opening/closing mechanism 21B. This opening/closing mechanism 21B has a lid 22B and an elevating cylinder 25 for raising and lowering the lid 22B in the vertical directions shown by the arrows E1 and E2.

The lid 22B is linked with the piston rod 26 of the elevating cylinder 25 and can pivot in the direction of the arrows R1 and R2 about the axis 27 with respect to the piston rod 26 by an actuator 30.

Figure 12:
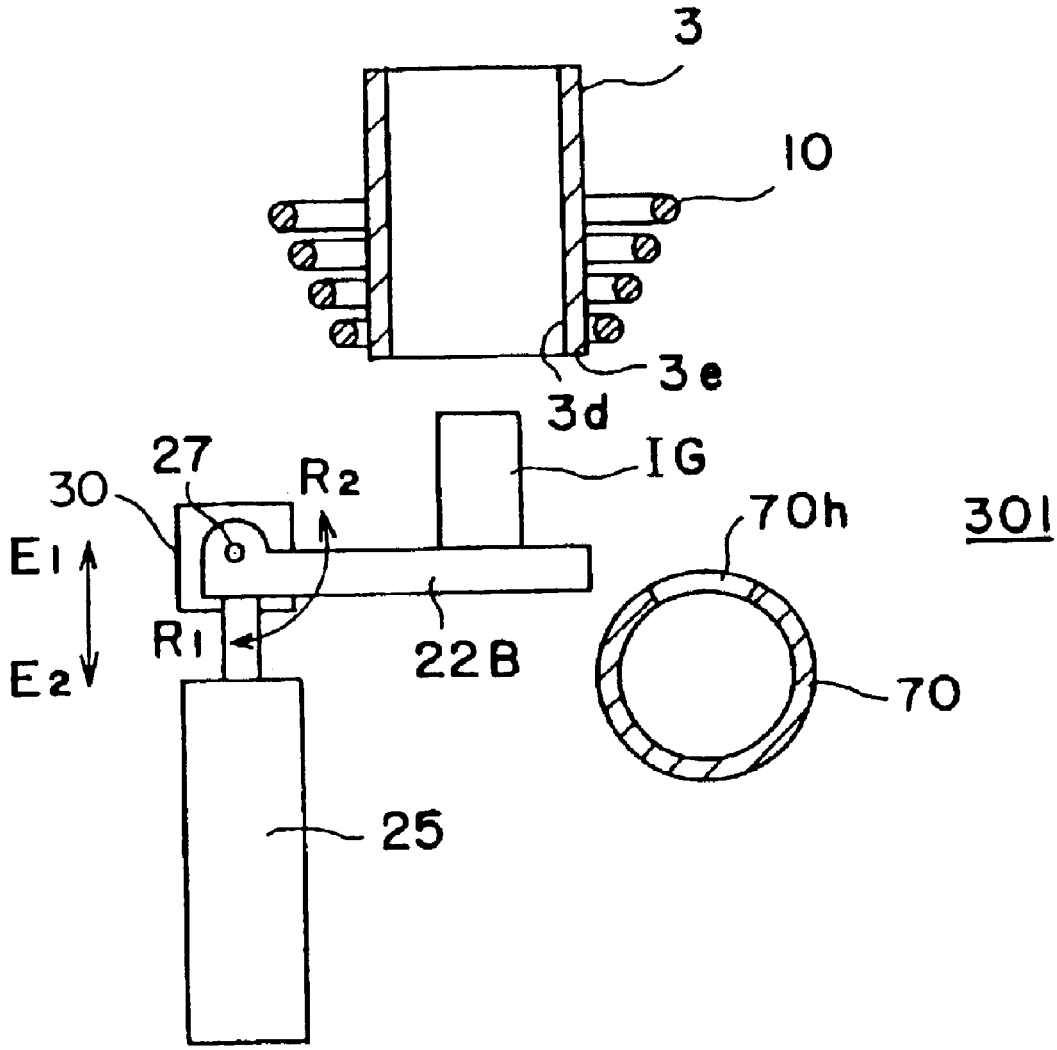
FIG. 12 is a view of the state before insertion of an ingot into the holding vessel in a molten metal feed apparatus.

FIG. 12 is a view of the state before insertion of an ingot IG in the holding vessel 3 in the molten metal feed apparatus 301.

The lid 22B is lowered in the direction of the arrow E2 and the ingot IG is placed on the lid 22B held in a horizontal state.

When the lid 22B is raised in the direction of the arrow E1 from this state, as shown in FIG. 11, the lid 22B abuts against the bottom end face 3*e* of the holding vessel 3, whereby the opening 3*d* of the holding vessel 3 is closed.

Figure 13:
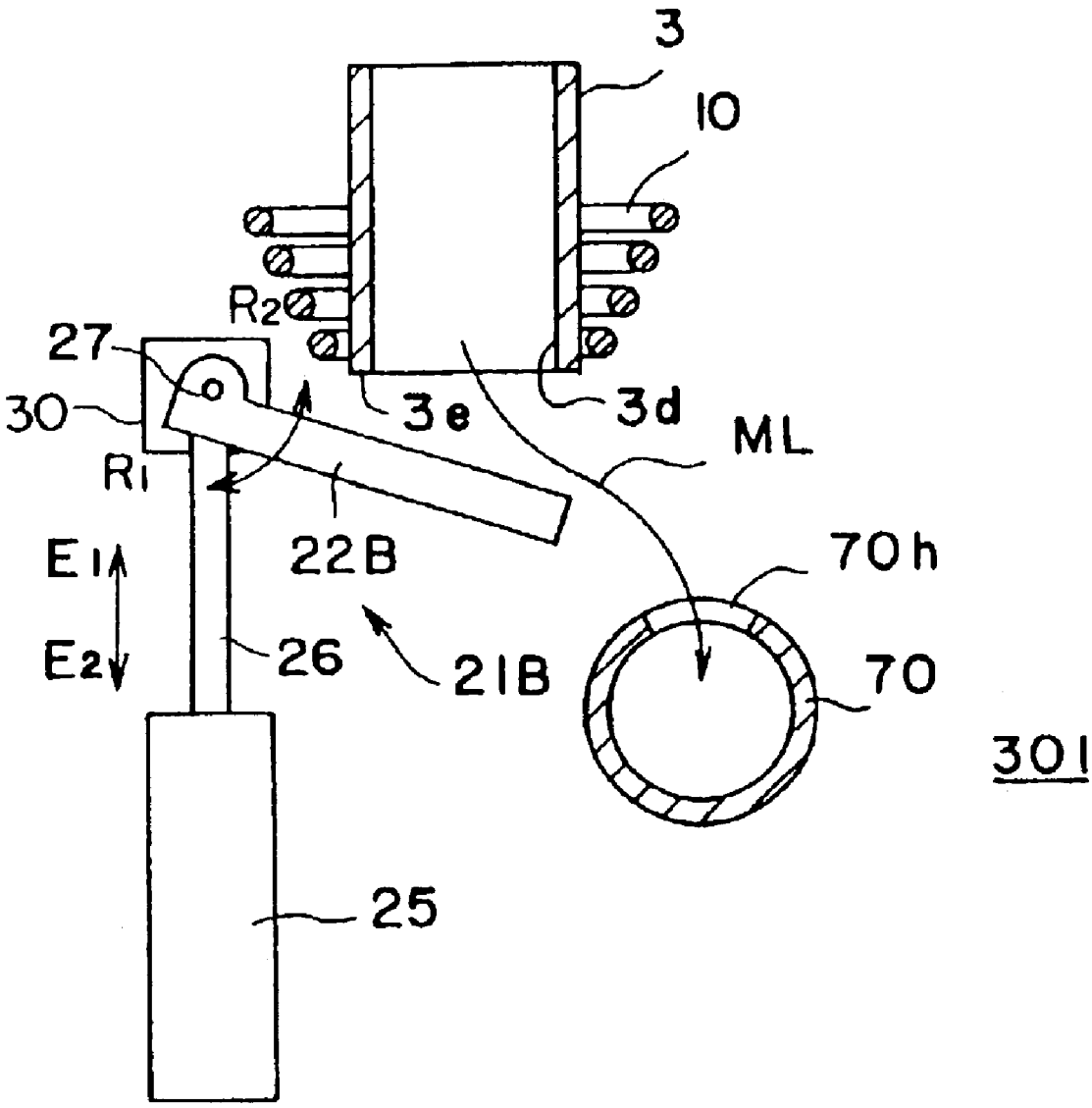
FIG. 13 is a view for explaining a procedure for feeding molten metal into a sleeve in a molten metal feed apparatus.

In the state shown in FIG. 11, induction heating is used to heat and melt the ingot IG, then, as shown in FIG. 13, the lid 22B is made to pivot in the direction of the arrow R1 to open the opening 3*d* of the furnace 3 and thereby feed molten metal ML inside the sleeve 70.

In this way, in the molten metal feed apparatus 301 of the present embodiment, the opening/closing mechanism 21B opens and closes the opening 3*d* of the holding vessel 3 and performs the role of the metal material feeding means for feeding the ingot IG inside the holding vessel 3.

According to the molten metal feed apparatus 301 of the present embodiment, a mass of metal material such as an ingot is fed into the holding vessel 3, so the oxidation of the metal material can be suppressed so that the quality of the molten metal can be improved. Further, it becomes possible to make the volume of the metal material smaller.

Note that the molten metal feed apparatus 301 according to the present embodiment can make use of the various modifications of the holding vessel 3 and induction heating coil 10 explained above.

Fourth Embodiment

FIG. 14 to FIG. 17 are views of the configuration of a molten metal feed apparatus according to a fourth embodiment of the present invention.

In the above embodiments, the explanation was made of a technique for preventing the molten metal ML in the holding vessel 3 from leaking from any clearance formed between the lid 22 and the bottom end face 3*e* of the holding vessel 3.

When melting a metal material by induction heating in the holding vessel 3, however, from the viewpoint of suppression of oxidation of the metal, it is desirable to make the atmosphere in the holding vessel 3 an inert gas.

The larger the clearance formed between the lid 22 and the bottom end face 3*e* of the holding vessel 2, however, the longer the time required for replacement of the atmosphere and the greater the amount of inert gas required.

Further, if the clearance formed between the lid 22 and the bottom end face 3*e* of the holding vessel 3 is large, if the induction heating stops due to a blackout or other reason while melting the metal material in the holding vessel 3 due to the induction heating, the molten metal may leak out from the clearance formed between the lid 22 and the bottom end face 3*e* of the holding vessel 3.

Therefore, it is desirable to make the clearance formed between the lid 22 and the bottom end face 3*e* of the holding vessel 3 as small as possible.

In the present embodiment, a configuration enabling the clearance formed between the lid 22 and the bottom end face 3*e* of the holding vessel 3 to be reduced will be explained.

Figure 14:
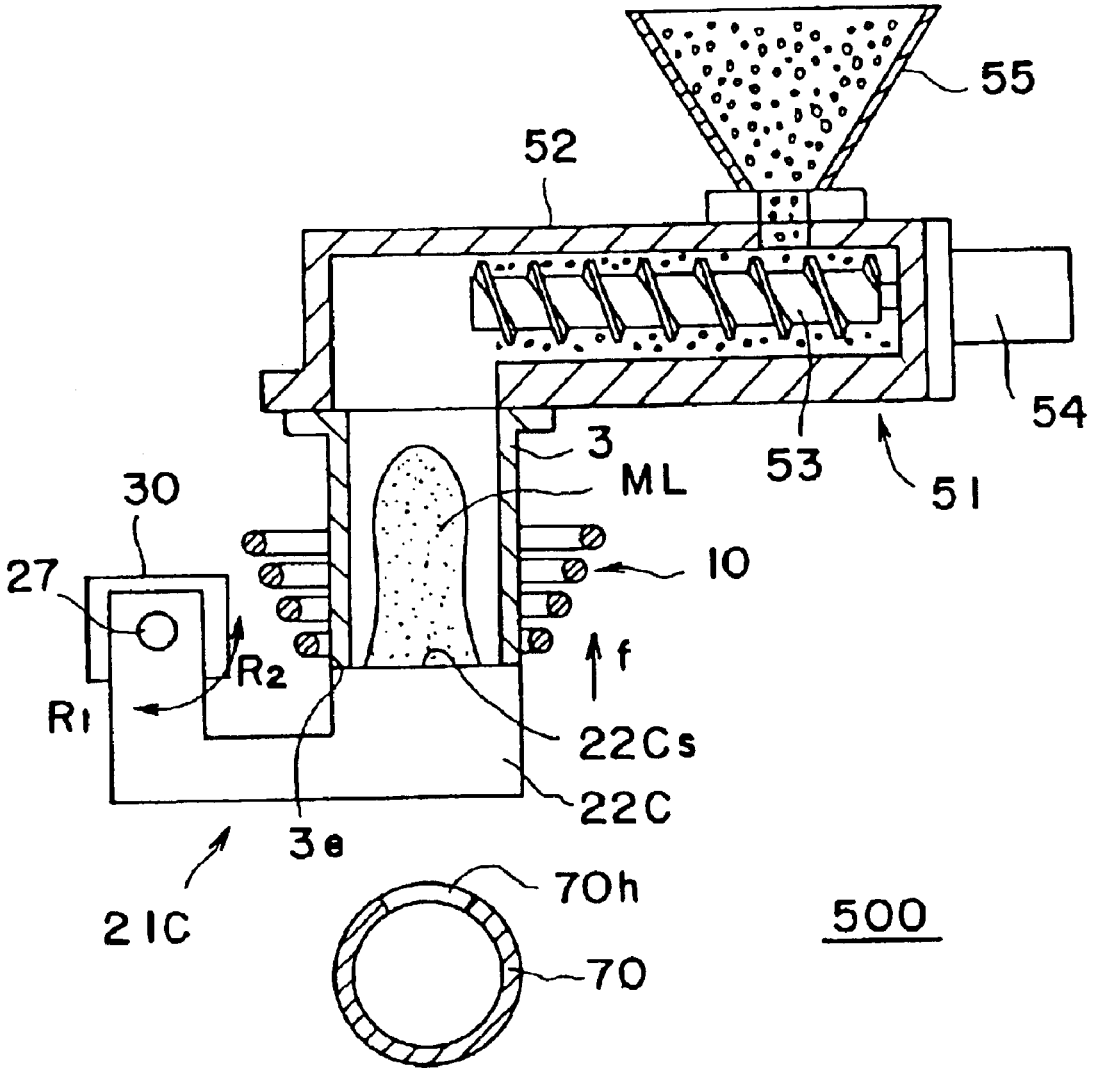
FIG. 14 is a view of the configuration of a molten metal feed apparatus according to a fourth embodiment of the present invention.

The molten metal feed apparatus 500 shown in FIG. 14 differs from the molten metal feed apparatus 1 according to the first embodiment explained above only in the opening/closing mechanism 21C. The rest of the configuration is the same.

In FIG. 14, the opening/closing mechanism 21C has a lid 22C and an actuator 30 for pivoting the lid 22C about a shaft 27.

The actuator 30 is for example configured by an electric motor and a transmission mechanism.

If driving the actuator 30 to make the lid 22C pivot in the direction of the arrow R2, the abutting face 22Cs of the lid 22C abuts against the bottom end face 3*e* of the holding vessel 3.

By maintaining a fixed output of the actuator 30 in the state with the abutting face 22Cs of the lid 22C abutting against the bottom end face 3*e* of the holding vessel 3 so as to press the abutting face 22Cs of the lid 22C against the bottom end face 3*e* of the holding vessel 3 by a predetermined force f, it is possible to reduce the clearance formed between the abutting face 22Cs and the bottom end face 3*e*.

Figure 15:
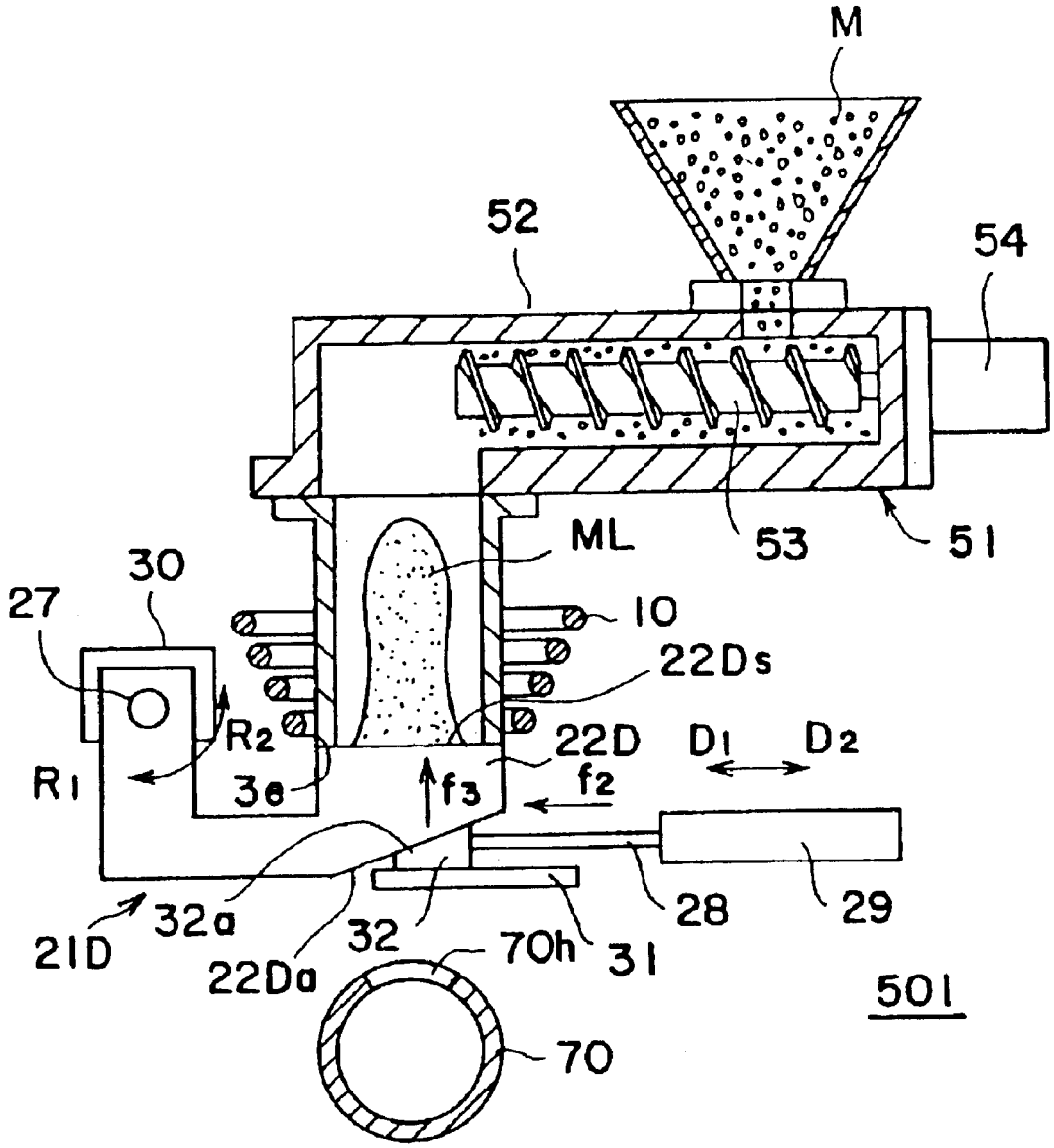
FIG. 15 is a view of a molten metal feed apparatus having another opening/closing mechanism.

FIG. 15 is a view of a molten metal feed apparatus having an opening/closing mechanism of another configuration. Note that the molten metal feed apparatus 501 shown in FIG. 15 is the same in configuration as the molten metal feed apparatus 500 shown in FIG. 14 except for the opening/closing mechanism. Further, components the same as the molten metal feed apparatus 500 shown in FIG. 14 are assigned the same reference numerals.

The opening/closing mechanism 21D shown in FIG. 15 has a lid 22D, an actuator 30 for making the lid 22D pivot about the shaft 27, a wedge member 32, a cylinder apparatus 29, and a guide member 31.

The lid 22D is provided at the opposite side to the abutting face 22Ds with an inclined face 22Da inclined by a predetermined angle with respect to the abutting face 22Ds.

The wedge member 32 is movably supported by the guide member 31 in the horizontal direction shown by the arrows D1 and D2. This wedge member 32 is provided with an inclined face 32*a* inclined relative to the inclined face 22Da of the lid 22D by the same angle as the inclined face 22Da at the surface opposite to the surface supported by the guide member 31.

The guide member 31, while not shown, is arranged parallel at the two sides below the holding vessel 3 so as not to obstruct the path of feed of the molten metal ML ejected from the opening 3*d* of the holding vessel 3 to the sleeve 70.

The cylinder apparatus 29 is provided with a piston rod 28 extending and contracting in the directions of the arrows D1 and D2. The front end of the piston rod 28 is linked with the wedge member 32. The cylinder apparatus 29 moves the wedge member 32 in the directions of the arrows D1 and D2 by extension and contraction of the piston rod 28 in the directions of the arrows D1 and D2.

If driving the actuator 30 to make the lid 22D pivot in the direction of the arrow R2, the abutting face 22Ds of the lid 22D abuts against the bottom end face 3*e* of the holding vessel 3.

If making the wedge member 32 move in the direction of the arrow D1 from this state, the inclined face 32*a* of the wedge member 32 and the inclined face 22Da of the lid 22D will strike each other. Further, the wedge member 32 will be made to advance in the direction of the arrow D1 and the wedge member 32 will be pressed by a force f2.

The force f2 pressing the wedge member 32 is converted to the force f3 pressing the lid 22D toward the bottom end face 3*e* of the holding vessel 3. At this time, the force f3 is amplified by the force f2 by the wedge effect.

Due to this, it is possible to press the lid 22D toward the bottom end face 3*e* of the holding vessel 3 by a large force and possible to reduce the clearance formed between the abutting face 22Ds and the bottom end face 3*e*. That is, in the configuration of the opening/closing mechanism shown in FIG. 14, it is necessary to have the actuator 30 generate a large force, but in this example, it is possible to convert the output of the cylinder apparatus 29 to a large force by the wedge effect, so it is not necessary to have the actuator 30 generate a large force.

Figure 16:
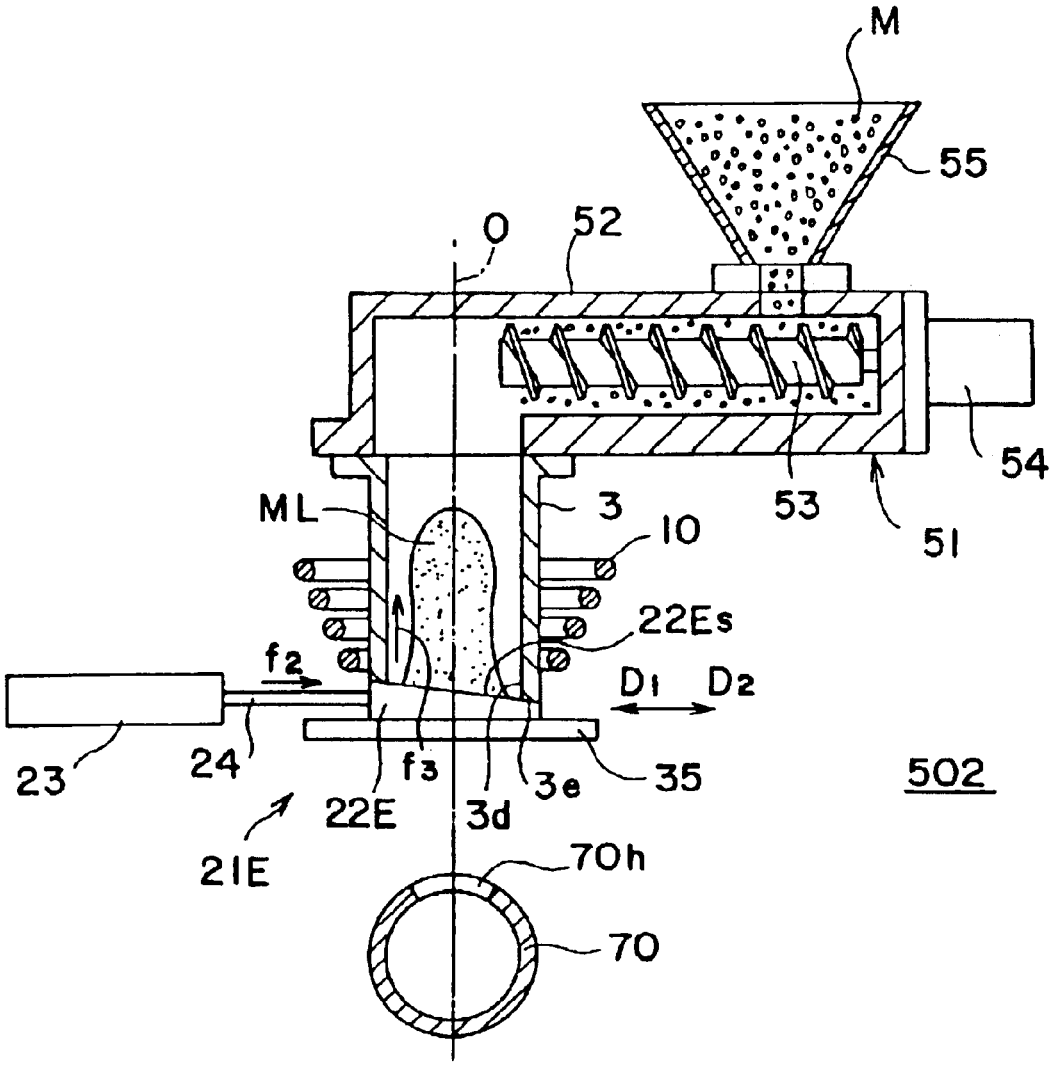
FIG. 16 is a view of a molten metal feed apparatus having still another opening/closing mechanism.

FIG. 16 is a view of a molten metal feed apparatus having still another opening/closing mechanism. Note that the molten metal feed apparatus 502 shown in FIG. 16 is the same in configuration as the molten metal feed apparatus 500 shown in FIG. 14 except for the opening/closing mechanism.

The opening/closing mechanism 21E shown in FIG. 16 has a lid 22E, a cylinder apparatus 23, and a guide member 35.

The lid 22E is supported by the guide member 35 movably in the horizontal direction shown by the arrows D1 and D2.

The abutting face 22Es of the lid 22E does not perpendicularly intersect the center axis O of the holding vessel 3, but is inclined with respect to the plane perpendicularly intersecting the center axis O by a predetermined angle.

On the other hand, the bottom end face 3*e* of the holding vessel 3 does not perpendicularly intersect the center axis O of the holding vessel 3, but is inclined with respect to the plane perpendicularly intersecting the center axis O by a predetermined angle.

The cylinder apparatus 23 makes the lid 22 move in the directions of the arrows D1 and D2 by extension and contraction of the piston rod 24 in the directions of the arrows D1 and D2.

The guide member 35, while not shown, is arranged parallel at the two sides below the holding vessel 3 so as not to obstruct the path of feed of the molten metal ML ejected from the opening 3*d* of the holding vessel 3 to the sleeve 70.

If using the cylinder apparatus 23 to make the lid 22E move in the direction of the arrow D2, the abutting face 22Es of the lid 22E will abut against the bottom end face 3*e* of the holding vessel 3, whereby the opening 3*d* of the holding vessel 3 will be closed by the lid 22E.

If further pressing the lid 22E in the direction of the arrow D2 by the force f2 in this state, due to the wedge effect between the bottom end face 3*e* and the abutting face 22Es, the force f2 is converted to a force f3 pressing the lid 22E against the bottom end face 3*e* of the holding vessel 3. Due to this, it is possible to press the lid 22E against the bottom end face 3*e* of the holding vessel 3 by a large force and possible to reduce the clearance formed between the abutting face 22Es and the bottom end face 3*e*.

In this example, the drive force of the actuator for opening and closing the lid 22E with respect to the opening 3*d* of the holding vessel, that is, the cylinder apparatus 23, is utilized to reduce the clearance formed between the abutting face 22Es and the bottom end face 3*e*, so it is not necessary to provide a separate actuator for pressing the lid 22E against the holding vessel 3.

Figure 17:
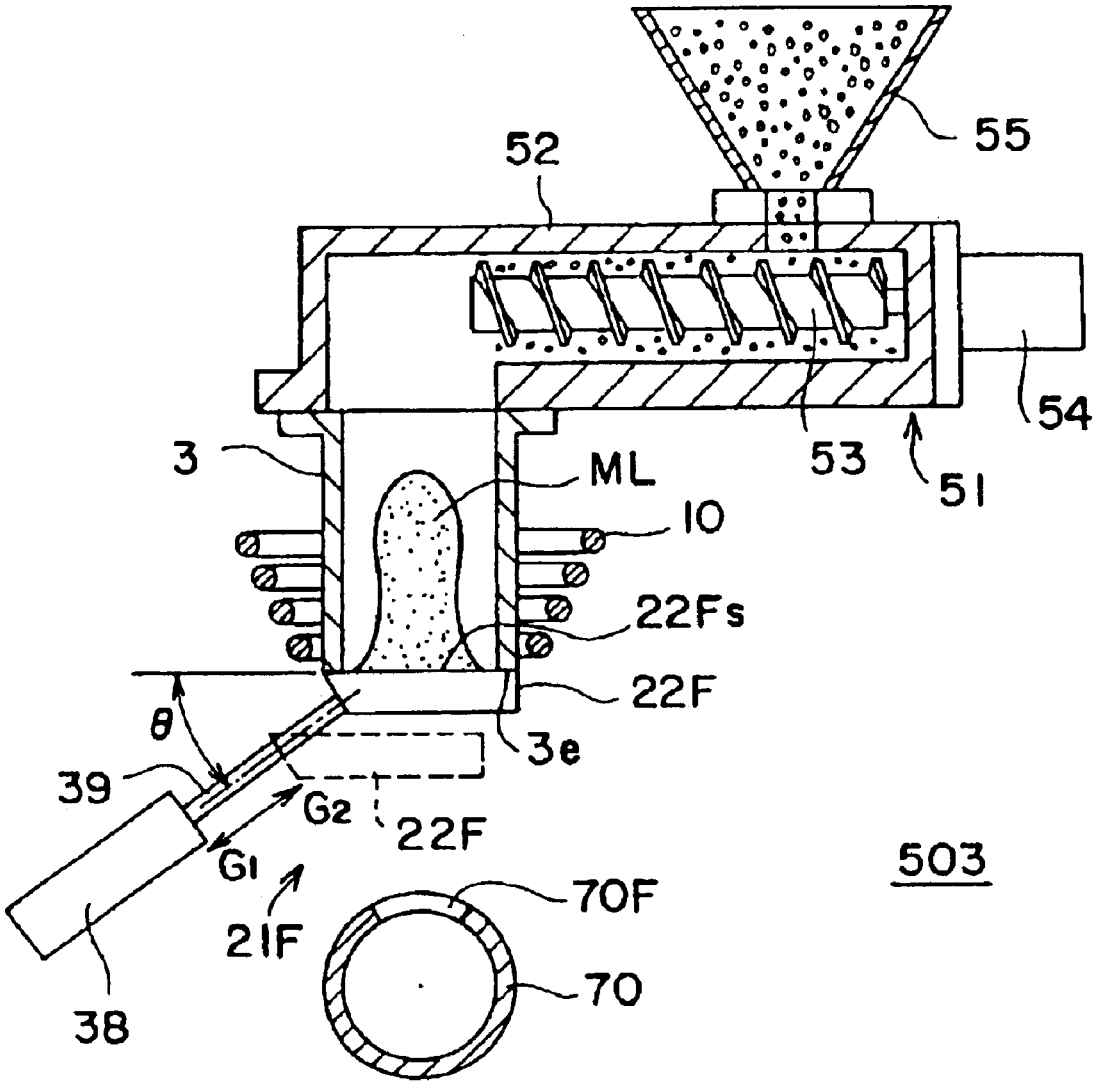
FIG. 17 is a view of a molten metal feed apparatus having still another opening/closing mechanism.

FIG. 17 is a view of a molten metal feed apparatus having still another opening/closing mechanism. Note that the molten metal feed apparatus 503 shown in FIG. 17 is the same in configuration as the molten metal feed apparatus 500 shown in FIG. 14 except for the opening/closing mechanism.

The opening/closing mechanism 21F shown in FIG. 17 is provided with a lid 22F and a cylinder apparatus 38.

The cylinder apparatus 38 is provided with a piston rod 39 extending and contracting in the directions of the arrows G1 and G2. The front end of the piston rod 39 is fixed to the lid 22F.

The directions G1 and G2 of extension and contraction of the piston rod 39 are not parallel to the bottom end face 3*e* of the holding vessel 3, but are inclined by a predetermined angle θ with respect to the bottom end face 3*e*.

The lid 22F is fixed to the piston rod 39 so that the abutting face 22Fs becomes parallel to the bottom end face 3*e* of the holding vessel 3.

If extending the piston rod 39 to make the abutting face 22Fs of the lid 22F abut against the bottom end face 3*e* of the holding vessel 3 and press the abutting face 22Fs against the bottom end face 3*e*, due to the wedge effect, the lid 22F is pressed against the bottom end face 3*e* of the holding vessel 3 by a larger force than the output of the cylinder apparatus 38.

Note that the molten metal feed apparatuses 500 to 503 shown in FIG. 14 to FIG. 17 were explained with reference to the case of provision of the material feed mechanism 15 as a metal material feeding means, but it is also possible to use the metal material feeding means explained in the second embodiment for the molten metal feed apparatuses 500 to 503.

Further, the molten metal feed apparatuses 500 to 503 according to the present embodiment can make use of the various modifications of the holding vessel 3 and induction heating coil 10 explained above.

Fifth Embodiment

Figure 18:
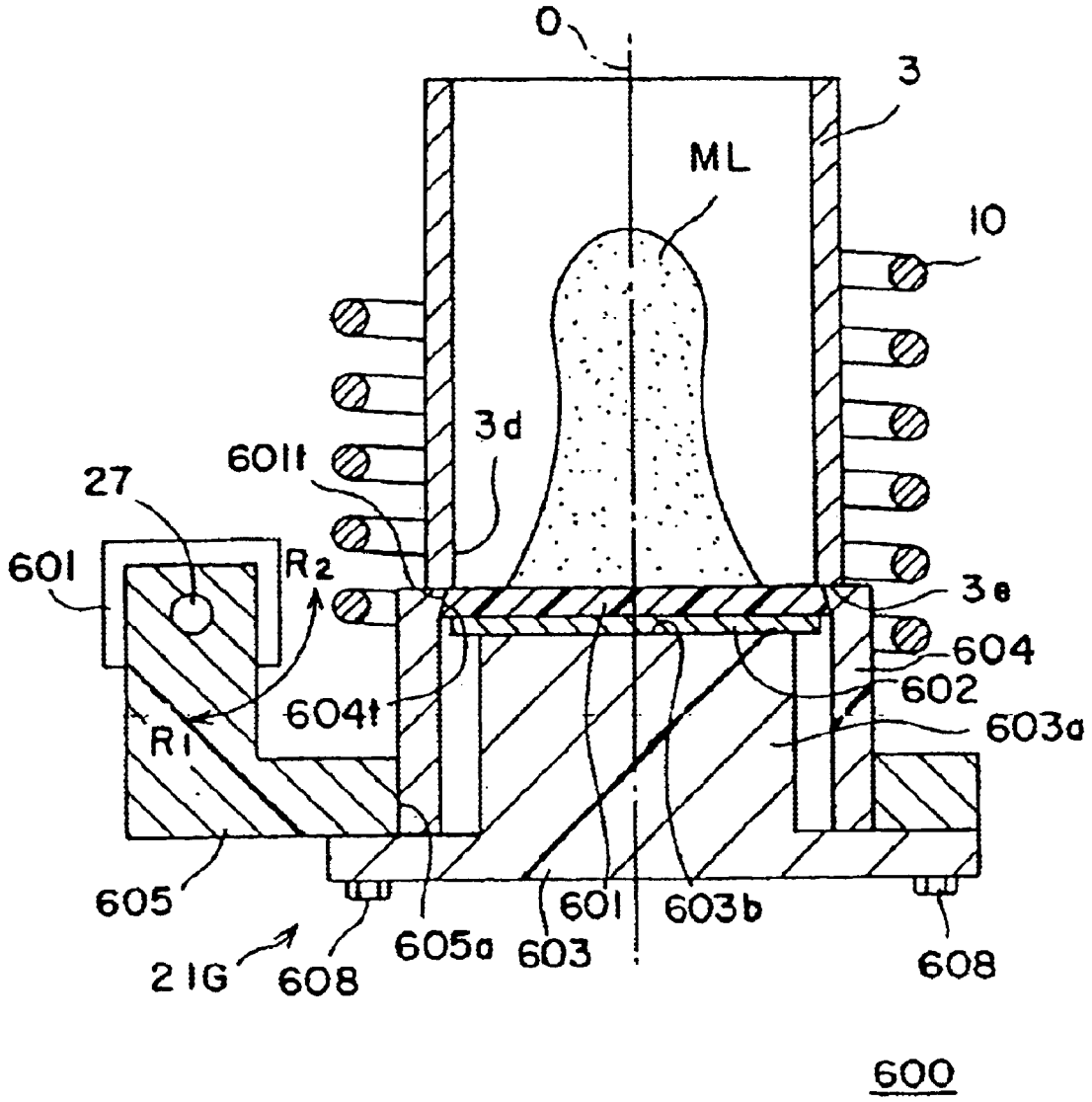
FIG. 18 is a sectional view of the configuration of a molten metal feed apparatus according to a fifth embodiment of the present invention.

FIG. 18 is a sectional view of the configuration of a molten metal feed apparatus according to a fifth embodiment of the present invention. Note that in FIG. 18, components the same as in the above components are assigned the same reference numerals. Further, the configurations of the holding vessel 3 and induction heating coil 10 are similar to those of the above embodiments.

In the molten metal feed apparatus according to the above embodiments, the magnetic flux generated by the induction heating coil 10 passes through the lid 22. When the material forming the lid 22 is iron or another ferromagnetic material, passage of magnetic flux results in an eddy current in the lid 22, whereby the lid 22 is heated. That is, part of the energy used for the induction heating is used for heating the lid 22, so an energy loss occurs.

Further, if the lid 22 continues being heated by the eddy current, the temperature of the lid 22 will rise too much and damage may occur.

In the present embodiment, a configuration enabling the energy loss due to the lid 22 to be prevented and heating of the lid 22 to be stopped will be explained.

In FIG. 18, the opening/closing mechanism 21G has a contact member 601, an elastic member 602, a flange member 603, a tubular member 604, and an actuator 610.

The contact member 601, elastic member 602, flange member 603, and tubular member 604 form the lid of the present invention.

The actuator 610 pivots the holding member 605 in the directions of the arrows R1 and R2.

The contact member 601 is a disk-shaped member arranged at a position coming into direct contact with the molten metal ML in the holding vessel 3. The outer circumferential surface of the contact member 601 forms a taper face 601*t* inclined at a predetermined angle.

The tubular member 604 is comprised of a cylindrically shaped member. The inner circumferential surface at the top end side forms a taper face 604*t* for supporting the taper face 601*t* of the contact member 601. The tubular member 604 fits at its outer circumference into a circular hole 605*a* formed in the holding member 605.

The flange member 603 is provided with a projection 603*a* to be inserted into the inner circumference of the tubular member 604. The outer circumference is fastened to the holding member 605 by bolts 608. The top face of the projection 603*a* of the flange member 603 becomes the support face 603*b* supporting the bottom face side of the contact member 601 through the elastic member 602.

The elastic member 602 is comprised of a disk-shaped member and is sandwiched between the bottom face of the contact member 601 and the support face 603*b* of the flange member 603. The elastic member 602 is formed by a material elastically deformable when acted on by a compression force from the bottom face of the contact member 601 and the support face 603*b* of the flange member 603. Specifically, it is formed by bulk fiber paper etc.

The holding member 605 is formed, at the outer circumference of the circular hole 605*a* into which the tubular member 604 is fit, with a not shown notch so as to cut the path of the induction current arising due to the magnetic field occurring in the induction heating coil 10.

In the present embodiment, to prevent heating of the lid due to the eddy current at the time of induction heating, the lid is formed not from a ferromagnetic material such as iron, but from a metal not a ferromagnetic material such as austenitic stainless steel or copper or an insulator such as a ceramic (these being referred to as "nonferromagnetic materials").

Specifically, the material forming the holding member 605 is made for example copper and the materials forming the contact member 601, flange member 603, and tubular member 604 are made for example ceramic materials.

Further, the contact member 601 comes directly into contact with the molten metal ML, so a large amount of heat is conducted in a short time. Therefore, the contact member 601 is formed by a material stable at a high temperature and tough against thermal shock. Specifically, for example, silicon nitride ($Si_3N_4$), silicon aluminum oxynitride ($Si_3N_4$—$Al_2O_3$), boronitride (BN), aluminum titanate ($TiO_2$—$Al_2O_3$), or another ceramic material may be mentioned.

Further, the contact member 601 can be damaged by the heat stress if the temperature difference becomes large inside the contact member 601, so it is preferable to reduce the heat capacity of the contact member 601 as much as possible. Therefore, the contact member 601 is made a plate shape and its thickness is determined considering the heat conductivity and the toughness with respect to the internal stress due to heat of the material forming the contact member 601. Specifically, when melting aluminum, magnesium, or other metal and using a ceramic material for the material forming the contact member 601, considering the fact that the melting temperature of aluminum or magnesium is about 700° C., the thickness of the contact member 601 is preferably about 3 to 8 mm. If a thickness over this, a large temperature difference will arise between the surface of the contact member 601 at the side contacting the molten metal ML and the surface at the opposite side, cracks will occur in the direction along the surface of the contact member 601, and use will become impossible. Further, if too thin, the member will easily break. Therefore, the thickness is preferably made at least 3 mm.

In the molten metal feed apparatus 600 of the above configuration, if melting the metal material by induction heating inside the holding vessel 3, the contact member 601 becomes extremely high in temperature due to direct contact with the molten metal ML and expands to the heat.

The heat expansion of the contact member 601 in the radial direction is absorbed by the contact member 601 moving downward due to the interaction between the taper face 601*t* of the contact member 601 and the taper face 604*t* of the tubular member 604 and striking the elastic member 602.

The heat expansion of the contact member 601 in the thickness direction is absorbed by the contact member 601 pressing against the elastic member 602 as it is.

Therefore, the contact member 601 is resistant to damage by heat stress.

As explained above, according to the molten metal feed apparatus 600 of the present embodiment, by suitably selecting the material of the lid not requiring heating, it is possible to suppress energy loss at the time of induction heating, possible to suppress heating of the lid, and possible to extend the life of the lid.

Further, by configuring the lid by a plurality of members, in particularly by configuring the portion coming into direct contact with the molten metal ML by the contact member 601 and adopting a structure able to absorb the heat expansion of the contact member 601, it becomes possible to greatly extend the life of the most likely to break contact member 601.

Note that in the present embodiment, the holding vessel 3, the contact member 601, the tubular member 604, the flange member 603, and the elastic member 602 were made circular in sectional shape in the horizontal direction, but the sectional shape of these members in the horizontal direction may be made any shape (for example, squares) and gradients may be given to the surfaces where the contact member 601 and tubular member 604 contact each other.

Further, in the present embodiment, an elastic member 602 was used for absorbing the heat expansion of the contact member 601. When using a ceramic material for the contact member 601, however, the heat expansion rate is not that large, so it is also possible not to use an elastic member 602 and to select a material able to absorb the expansion of the contact member 601 for the ceramic material used as the material forming the flange member 603.

Further, the molten metal feed apparatus 600 according to the present embodiment was not provided with a metal material feeding means for feeding the metal material to the holding vessel, but the molten metal feed apparatus 600 may also be made a molten metal feed apparatus using a metal material feeding means as explained in the first to third embodiments.

Further, the molten metal feed apparatus 600 according to the present embodiment can make use of the various modifications of the holding vessel 3 and induction heating coil 10 explained above.

Further, it is possible to press the lid of the molten metal feed apparatus 600 according to the present embodiment against the bottom end face of the holding vessel 3 by applying the technique explained with reference to the fourth embodiment.

While the invention has been described with reference to specific embodiments chosen for purpose of illustration, it should be apparent that numerous modifications could be made thereto by those skilled in the art without departing from the basic concept and scope of the invention.

In the above embodiments, the explanation was given with reference to an example of a die casting machine as a casting apparatus fed the molten metal from the molten metal feed apparatus of the present invention, but the invention is not limited to this. For example, it can also be applied to a casting apparatus using sand casting or gravity die casting or another casting method.

Further, the molten metal feed apparatuses of the above embodiments were explained with reference to the case of the metal material to be melted being mainly aluminum, but it is also possible to heat and melt high melting point metals such as magnesium and titanium by making the inside of the holding vessel an inert gas atmosphere.

What is claimed is:

1. A molten metal feed apparatus for feeding molten metal to a casting apparatus comprising:

a holding vessel having an opening at its bottom and holding a metal material;

a lid for closing said opening;

a drive means for making said lid move with respect to said holding vessel to open or close said openings; and an induction heating coil for heating and melting said metal material by induction of a current to said metal material in said vessel, said induction heating coil being wound around said vessel, a diameter of said induction heating coil increasing from a bottom of said holding vessel to an upper portion where a top of said molten metal is positioned so as to generate a magnetic field applying to said molten metal a force preventing leakage of said molten metal in said holding vessel from between said opening and said lid.

2. A molten metal feed apparatus as set forth in claim 1, wherein:

said holding vessel comprises a cylindrical body, said lid comprises an abutting face for abutting against a bottom end face of the cylindrical body, and said induction heating coil is arranged around said cylindrical body concentrically with a center axis of said cylindrical body and has an arrangement and/or shape generating a magnetic field causing a force preventing leakage of said molten metal from between said bottom end face of said cylindrical body and said abutting face of said lid to act on said molten metal.

3. A molten metal feed apparatus as set forth in claim 2, wherein said cylindrical body is formed from a nonferromagnetic material.

4. A molten metal feed apparatus as set forth in claim 2, wherein a thickness of said cylindrical body is less than a depth of penetration of an eddy current generated at said cylindrical body due to said induction heating coil.

5. A molten metal feed apparatus as set forth in claim 2, wherein said cylindrical body comprises a notch for cutting a path of an eddy current generated at said cylindrical body due to said induction heating coil.

6. A molten metal feed apparatus as set forth in claim 5, wherein said notch comprises an insulator.

7. A molten metal feed apparatus as set forth in claim 2, wherein said cylindrical body is formed by an insulator.

8. A molten metal feed apparatus as set forth in claim 1, wherein said opening is arranged at a position for feeding molten metal to a gate of a casting apparatus.

9. A molten metal feed apparatus as set forth in claim 1, further provided with a metal material feeding means for feeding a metal material to said holding vessel.

10. A casting apparatus comprising a molten metal feeding means for feeding a molten metal, said molten metal feeding means comprising:

a holding vessel having an opening at its bottom and holding a metal material, a lid for closing said opening, a drive means for making said lid move with respect to said holding vessel to open or close said opening, and an induction heating coil for heating and melting said metal material by induction of a current to said metal material in said vessel, said induction heating coil being wound around said vessel, a diameter of said induction heating coil increasing from a bottom of said holding vessel to an upper portion where a top of said molten metal is positioned so as to generate a magnetic field applying to said molten metal a force preventing leakage of said molten metal in said holding vessel from between said opening and said lid.

* * * * *